United States Patent [19]

Engstrom et al.

[11] Patent Number: 4,734,288

[45] Date of Patent: Mar. 29, 1988

[54] PACKAGE FOR EXPANDABLE FOOD PRODUCT

[75] Inventors: Rolf G. Engstrom; Douglas M. Fincham, both of Edina, Minn.

[73] Assignee: E. A. Sween Company, Eden Prairie, Minn.

[21] Appl. No.: 38,455

[22] Filed: Apr. 10, 1987

Related U.S. Application Data

[63] Continuation of Ser. No. 676,073, Nov. 29, 1984, abandoned.

[51] Int. Cl.[4] ..... B65B 25/22; B65B 29/08; B65D 75/38; B65D 81/34

[52] U.S. Cl. ..... 426/107; 426/111; 426/113; 426/118; 426/124; 426/234; 220/403; 220/462; 220/463; 229/41 R; 229/903; 229/101; 229/DIG. 14; 229/DIG. 3; 206/813; 383/100; 53/440; 53/449; 156/293; 156/275.7

[58] Field of Search ..... 426/107, 111, 234, 113, 426/118, 124, 411, 412, 407; 229/DIG. 3, DIG. 4, DIG. 14, 903, 101; 220/462, 463, 403; 383/84, 120, 100; 156/293, 275.7

[56] References Cited

U.S. PATENT DOCUMENTS

| | | | |
|---|---|---|---|
| 1,299,503 | 4/1919 | Pente | 229/22 |
| 1,385,831 | 7/1921 | Hulbert | 383/120 |
| 2,159,835 | 5/1939 | Waters | 426/124 |
| 2,369,765 | 2/1945 | Waters | 426/411 |
| 2,633,284 | 3/1953 | Moffett et al. | 426/118 |
| 2,858,970 | 11/1958 | Barnes et al. | 426/111 |
| 2,865,768 | 12/1958 | Barnes et al. | 426/111 |
| 3,052,554 | 9/1962 | Colman | 426/111 |
| 3,198,420 | 8/1965 | Hiersteiner | 229/DIG. 3 |
| 3,314,210 | 4/1967 | Jarund | 426/124 |
| 3,443,971 | 5/1969 | Wood | 426/124 |
| 3,502,488 | 3/1970 | Bridgford | 426/128 |
| 3,539,360 | 11/1970 | Wood | 426/124 |
| 3,716,180 | 2/1973 | Bemiss et al. | 426/118 |
| 3,806,618 | 4/1974 | Bemiss | 426/118 |
| 3,851,574 | 12/1974 | Katz et al. | 426/107 |
| 3,955,749 | 5/1976 | Turkenkopf | 229/DIG. 3 |
| 3,997,677 | 12/1976 | Hirsch et al. | 426/118 |
| 4,013,798 | 3/1977 | Goltsos | 426/107 |
| 4,141,487 | 2/1979 | Faust et al. | 426/111 |
| 4,248,901 | 2/1981 | Austin | 426/124 |
| 4,260,101 | 4/1981 | Webinger | 426/111 |
| 4,261,504 | 4/1981 | Cowan | 426/118 |
| 4,277,506 | 7/1981 | Austin | 426/111 |
| 4,279,933 | 7/1981 | Austin et al. | 426/111 |
| 4,292,332 | 9/1981 | McHam | 426/111 |
| 4,344,537 | 8/1982 | Austin | 206/611 |
| 4,358,466 | 11/1982 | Stevenson | 426/118 |
| 4,390,554 | 6/1983 | Levinson | 426/107 |
| 4,404,241 | 9/1983 | Mueller et al. | 426/118 |
| 4,448,309 | 5/1984 | Roccaforte et al. | 426/107 |
| 4,453,665 | 6/1984 | Roccaforte et al. | 426/107 |
| 4,525,367 | 6/1985 | Allison | 426/111 |
| 4,586,649 | 5/1986 | Webinger | 426/113 |

FOREIGN PATENT DOCUMENTS

| | | | |
|---|---|---|---|
| 504311 | 4/1939 | United Kingdom | 383/84 |

*Primary Examiner*—Steven Weinstein
*Attorney, Agent, or Firm*—Dorsey & Whitney

[57] ABSTRACT

A package for an expandable food product and a method for manufacturing the same including an outer container, an expandable food pouch within the container and a coating on the inside surface of the container to adhere the pouch thereto when the package is exposed to a source of heat. A further embodiment of the package includes an expandable food pouch with a designed fault along its peripheral edge to facilitate the controlled release of pressure formed within the pouch.

17 Claims, 12 Drawing Figures

PACKAGE FOR EXPANDABLE FOOD PRODUCT

This is a continuation of Ser. No. 676,073, filed Nov. 29, 1984, and now abandoned.

BACKGROUND OF THE INVENTION

The present invention relates generally to an improved package for an expandable food product, and more particularly, to the combination of a food pouch and container for an expandable food product such as popcorn. The present invention also relates to a method of manufacturing such a package.

There are many expandable food packages existing in the prior art. Such packages are designed for expandable food products such as popcorn and function to both store the product in its uncooked condition and contain the produced in its expanded condition. With a product such as popcorn, exposing the kernels to a source of heat will cause the food product to expand, thereby causing similar expansion of the package. Initially, these packages were constructed of a metal or metal foil container and were adapted for exposure to a source of heat such as by placement of the package in a conventional convection oven or over a stove burner. In more recent years with the advent of the microwave oven, several new packages and containers have become available for the cooking of expandable food products in microwave ovens. Most of these are constructed of a paperboard material and include various means for containing the food as it expands during microwave heating.

One such prior art package consists of an expandable paper bag into which the expandable food product such as popcorn, together with cooking oils, etc. are placed. The bag is then folded for compact storage. When microwave energy is applied, the popcorn pops to expand the bag which then functions to contain the product. Another package comprises an expandable cardboard container which is first opened and the popcorn kernels, cooking oils, etc. placed directly into the bottom of the package. The package is then latched before exposing the same to microwave heating. Still another prior art package comprises an outer cardboard container having a generally polygonal shaped base, a plurality of sidewalls and a plurality of top petals or leaves which open up as the food product expands. The food product is contained within this outer container by a plastic food pouch. One advantage of this latter type of package is that the inner plastic pouch is sealed to provide the product with a relatively long shelf life. This permits the product to be stored for extended periods of time on grocery store shelves and in inventory without refrigeration.

While this latter prior art package described above with the expandable plastic pouch is an acceptable package in many respects, it does have several limitations. First, the plastic pouch is contained in a relatively low and flat outer container having a relatively low and flat outer container having a relatively small polygonal shaped base portion. Thus, the package itself is unstable and often results in the food product being spilled unless care is taken when opening the plastic pouch or handling the package.

Secondly, although the plastic pouch functions satisfactorily to extend the shelf life of the food product without refrigeration, it is not secured to the outer container in any way. Thus, after the food product has been heated and its expansion is complete, it is often difficult to open the pouch without spilling the contents. For example, when the expandable food is popcorn, the plastic pouch which contains the popped corn will tend to shift about within the outer container when the pouch is open or when the container is carried about. This shifting of the pouch often results in the popcorn being spilled or the pouch falling out of the outer container. Even during the popping of the corn, the force of the exploding kernels can shift the position of the pouch so that the seam is not in the proper position to be opened. When this happens the hot oil can come in prolonged contact with the seam causing a premature rupture that results in undesirable spillage on the microwave oven floor.

Thirdly, the expandable pouch, when heated, will normally expand to a size which causes the pouch to explode or a portion of the seam to give way, thus, permitting the release of pressure within the pouch. A disadvantage of current pouch designs is that there is no control over the location at which the seam will fail or the size of the opening that will be made when it does fail. Many times the opening is large enough to permit the popped corn to leak from the pouch.

Accordingly, there is a need for an expandable food package which is stable, which prevents the expandable pouch from shifting about during heating and which prevents the uncontrolled failure of the pouch seam or bursting of the pouch during heating.

SUMMARY OF THE INVENTION

As an improvement of the packaging which presently exists in the prior art and the method of manufacturing such packaging, the present invention relates to the combination of an outer container and an expandable food pouch for use with an expandable food product such as popcorn. Specifically, the package of the present invention includes an outer container having a base and a plurality of sidewalls. The sidewalls are sufficient in height to contain the food product in its expanded form. The base should be large enough to provide the container with sufficient stability, thereby preventing the container from being inadvertently tipped, but small enough to permit collection of the cooking oil during the cooking process. Positioned within this outer container is an expandable plastic food pouch which includes a sealed central portion for containing the expandable food product. As heat is applied to the food product, the food product expands, thus also expanding the plastic pouch and the outer container. Preferably the open top of the container is larger than the base to accommodate the expanding pouch.

To prevent the plastic pouch from shifting around inside the outer container, both during the time the food product is expanding as well as after when the pouch is opened and the package is carried about, at least a portion of the inner surface of the outer container is provided with a coating which becomes tacky and tends to fuse with or stick to the plastic pouch within the outer container when exposed to microwave energy. In the preferred embodiment, this coating is a synthetic material such as polyethylene which is a solid at room temperatures and which becomes tacky when exposed to the level of microwave energy needed to pop the kernels of popcorn. As this coating softens the plastic pouch fuses to the coating to preclude the pouch from shifting about during expansion of the food product. After the heat source has been removed, the coating hardens, thereby securing the expanded pouch to the outer container.

In the preferred embodiment, the entire inside surface of the outer container is coated; however, it is contemplated that in some instances it may be desirable to pattern coat the inside surface so that the pouch does not stick, for example, to the upper sides of the container. Such pattern coating permits the pouch to climb the sidewalls of the container without prematurely contacting and becoming fused with the upper portion of the sidewalls.

A further feature of the package of the present invention is a fold-over top flap which joins the top edges of the container together. This flap includes a small amount of heat sensitive adhesive or other material which is utilized to hold the flap in place and the package in a closed position. Then as the package is heated, the heat sensitive adhesive holding the package together melts and is forced apart by the expanding inner pouch. This feature adds simplicity of use to the packages and permits the user to merely place the container into the microwave oven and actuate the same without being required to perform any preparatory steps.

Another feature of the present invention comprises an improved pouch with a molded seam incorporating a designed or engineered fault to permit the location of the seam failure and the size of the opening caused by such failure to be controlled. This is particularly useful when stronger materials and sealing techniques are utilized. In such instances, bursting of the pouch can be avoided and the size of the seam opening can be limited to avoid leakage of popped corn.

Accordingly, it is an object of the present invention to provide an improved package for an expandable food product comprising an outer container and an expandable inner pouch.

Another object of the present invention is to provide an improved package for an expandable food product having an expandable pouch and an outer container provided with means for securing the pouch to the container during and following heating of the food product.

Another object of the present invention is to provide an improved package for an expandable food product in which at least a portion of the inner surface of the outer container is coated with a material which, during heating of the product, becomes tacky and fuses or sticks to the expanding plastic pouch to prevent the same from shifting about.

Another object of the present invention is to provide an outer container for an expandable food package in which only an area near the bottom of the container is coated with a material which fuses or sticks to the expanding food pouch as the product is heated.

Another object of the present invention is to provide a method for manufacturing such a package.

A still further object of the present invention is to provide an improved pouch having a designed fault in the seam to control the location of the seam failure and the size of the opening caused by such failure.

Another object of the present invention is to provide a method of manufacturing such an improved pouch with a designed fault in the seam.

These and other objects of the present invention will become apparent with reference to the drawings, the description of the preferred embodiment and the appended claims.

DESCRIPTION OF THE PREFERRED EMBODIMENT

Figure 1:
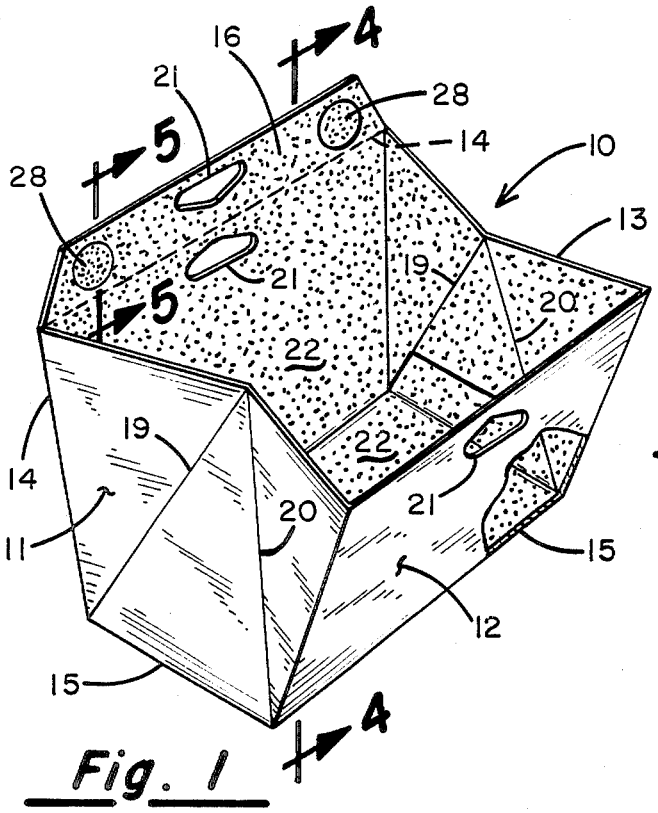
FIG. 1 is a pictorial view of the outer container of the expandable food package of the present invention with a portion broken away.
Figure 2:
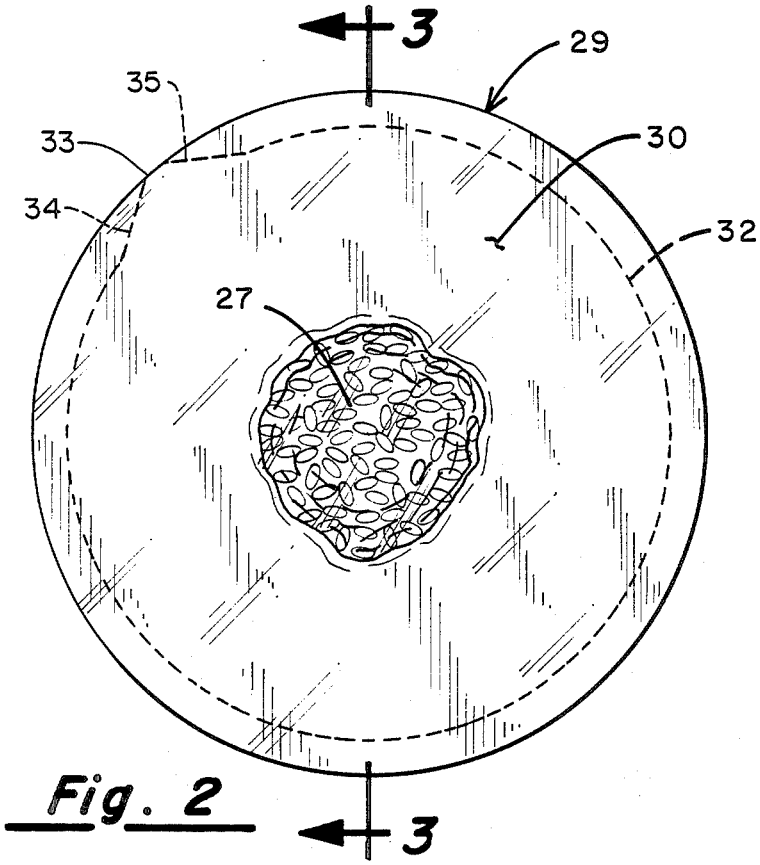
FIG. 2 is a top, elevational view of the expandable food pouch adapted for insertion into the outer container illustrated in FIG. 1 and for use in the packaging of the present invention.
Figure 3:
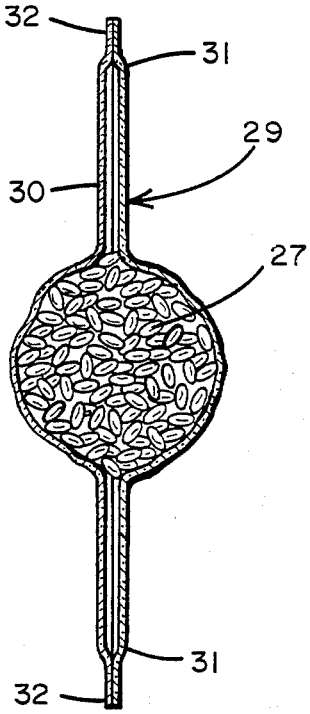
FIG. 3 is a view, partially in section, of the expandable food pouch as viewed along the section line 3—3 of FIG. 2.

Reference is first made to FIGS. 1, 2 and 3 showing the main components of the expandable food package of the present invention. FIG. 1 is a pictorial view of the outer container 10 while FIGS. 2 and 3 illustrate the expandable food pouch 29 adapted for insertion within the container 10. The container includes a base 15 and a plurality of sidewalls 11, 12, 13 and 14 extending upwardly from the base 15. Connected along the upper edge of the sidewall 14 is a closed flap 16.

Figure 6:
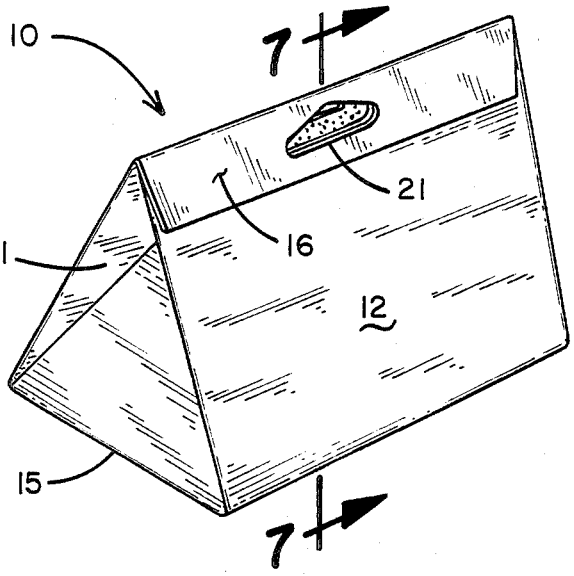
FIG. 6 is a pictorial view of the expandable food package of the present invention in its closed form.
Figure 7:
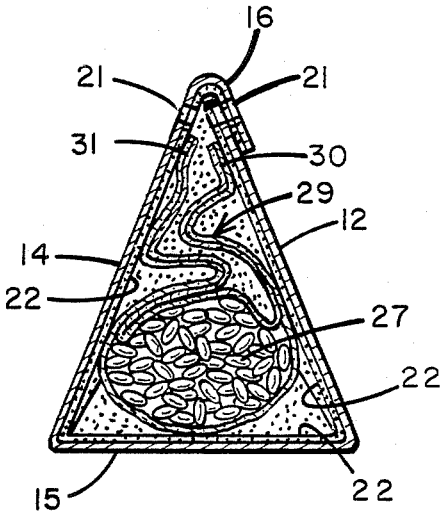
FIG. 7 is a view, partially in section, of the closed, expandable food package as viewed along the section line 7—7 of FIG. 6.

In the preferred embodiment, each of the sidewalls 11–14 is connected with and extends upwardly from the base 15. Each of the sidewalls 11, 12, 13 and 14 is also connected to an adjacent sidewall along a fold line so as to form a cavity for containing the expandable food pouch 29 (FIGS. 2 and 3). The sidewalls 11 and 13 include a plurality of fold lines 19 and 20 to permit the outer container to be folded into a package having a generally triangular shaped cross-sectional configuration as illustrated in FIGS. 6 and 7. As shown in FIGS. 1, 6 and 7, the flap 16 and the upper portion of each of the sidewalls 12 and 14 is provided with a hole 21 to permit the package to be hung for display purposes. The height of the sidewalls 11–14 should be sufficient to contain the pouch 29 and the food product in their fully expanded condition. Preferably the height of the sidewalls should be about one-fourth to one-half the generally circular pouch 29 in its flattened position as shown in FIG. 2. The preferred embodiment illustrated in the drawings shows the height of the sidewalls to be about one-third the diameter of the pouch 29.

Figure 5:
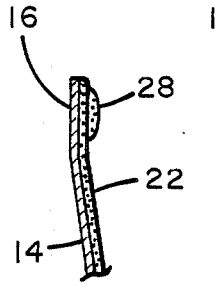
FIG. 5 is a view, partially in section, as viewed along the section line 5—5 of FIG. 1.

As shown best in FIGS. 1 and 5, a small amount of a heat sensitive adhesive material 28, 28 is disposed on the inside surface of the flap 16 so that when the container is collapsed into its closed form, the adhesive 28, 28 causes the flap 16 to adhere to the upper portion of the sidewall 12 to maintain the package in its closed position. The adhesive 28, 28 is formulated so that as it is exposed to microwave energy during heating, it will melt, or otherwise become disengaged from the sidewall 12 permitting the carton to open into the configuration illustrated in FIG. 1. This allows the food pouch to expand as the food product is heated.

In the preferred embodiment, the container 10 has four sides which are each generally trapezoidally shaped so that they extend upwardly and outwardly from the base 15. It is contemplated, however, that the container 10 could have many other shapes, configurations and number of sidewalls. It is important, however, for the base of the container to be smaller than the open top defined by the upper edge of the sidewalls. This causes the unpopped kernels and the cooking oil to fall back into and be concentrated in the lower portion of the container. It also permits the sloping sidewalls to guide and support the pouch as it expands. Preferably, the area of the container base should be between one-third and two thirds of the area of the container top. The preferred embodiment illustrated shows the area of the base to be about one-half the area of the container top.

Figure 10:
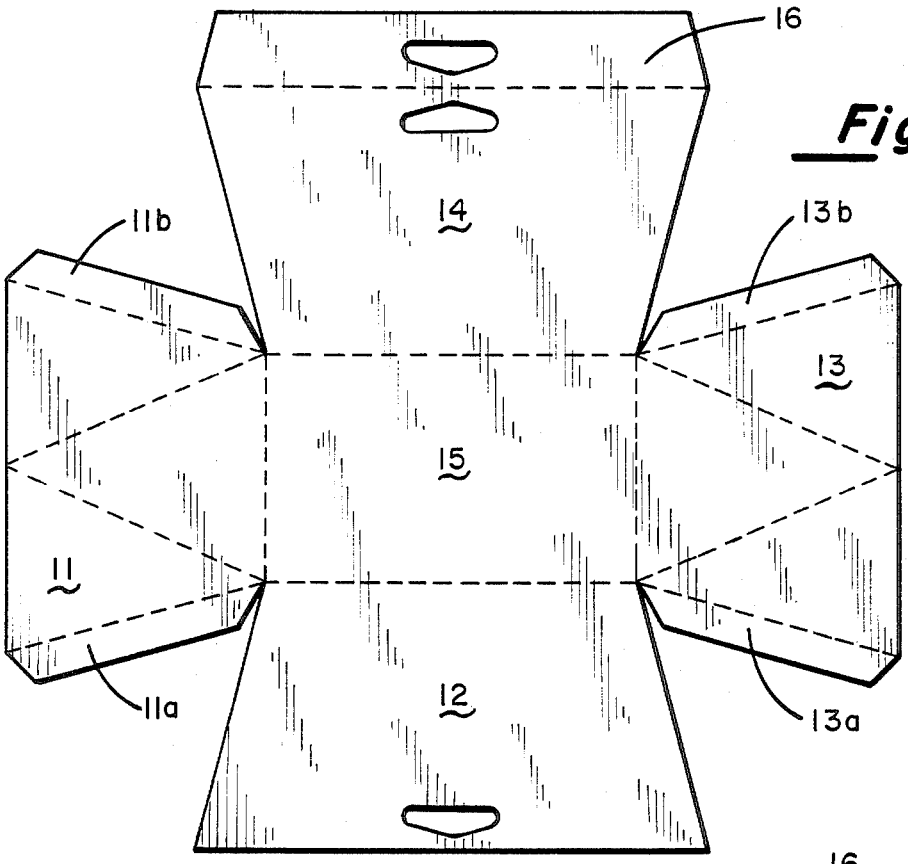
FIG. 10 is an elevational view of one embodiment of an outer container blank in accordance with the present invention in its collapsed form as it is cut from a piece of paperboard stock.
Figure 11:
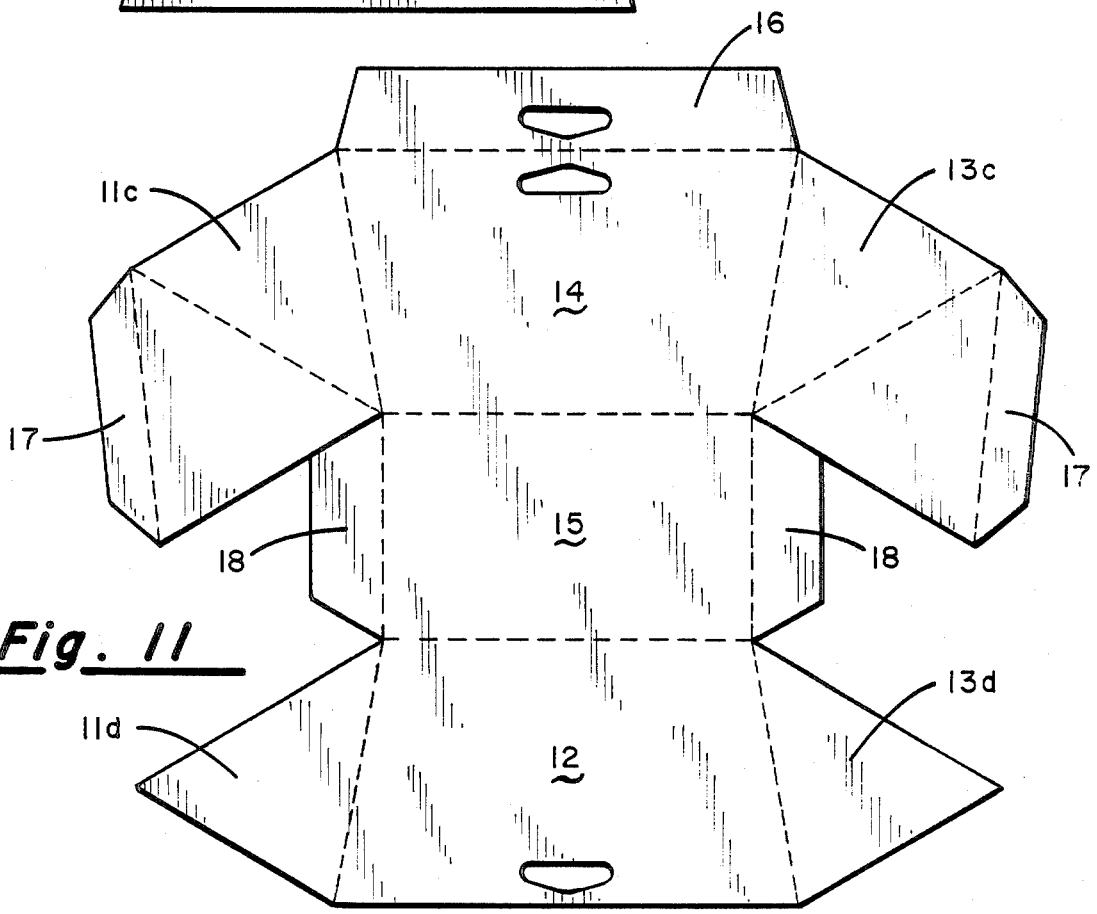
FIG. 11 is an elevational view of a second embodiment of an outer container blank in accordance with the present invention in its collapsed form as it is cut from a piece of paperboard stock.

The container 10 is made of standard solid bleached sulfate (SBS) paperboard stock or similar material and is formed from a cut-out blank of the type illustrated in FIGS. 10 and 11. FIGS. 10 and 11 show two embodiments of a blank which, when assembled, form an outer container of the type illustrated in FIG. 1. In FIG. 10, the blank includes a base 15, sidewalls 11, 12, 13 and 14 and connection tabs 11*a*, 11*b* and 13*a*, 13*b*. The tabs 11*a* and 11*b* are integrally joined with the sidewall 11 and are adapted for connection to the sidewalls 12 and 14, respectively. Similarly, the tabs 13*a* and 13*b* are integrally joined with the sidewall 13 and are adapted for connection to the sidewalls 12 and 14, respectively.

In FIG. 11, the blank includes a base 15, a pair of fully formed sidewalls 12 and 14 and sidewall sections 11*c*, 11*d* and 13*c*, 13*d* which, when assembled, join together to form the sidewalls 11 and 13, respectively. As shown, sections 11*d* and 13*d* are each comprised of a triangular section, while sections 11*c* and 13*c* are provided with a pair of triangular sections. A connection tab 17 is provided on the outer edges of each of the sections 11*c* and 13*c* for connecting sections 11*c* and 13*c* to sections 11*d* and 13*d*, respectively. In the embodiment of FIG. 11, an oil retaining tab 18 is provided at each end of the base 15 to contain oils, etc. which may inadvertently leak from the pouch during cooking.

Figure 9:
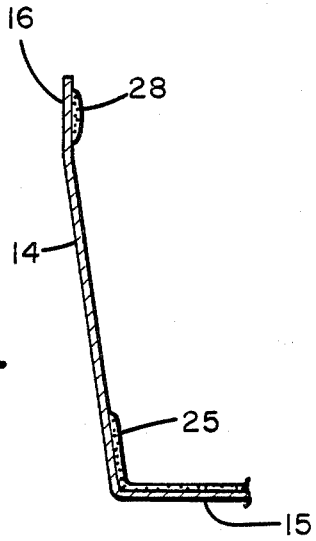
FIG. 9 is a view, partially in section, of one sidewall of a second embodiment of an expandable food package outer container in accordance with the present invention.
Figure 4:
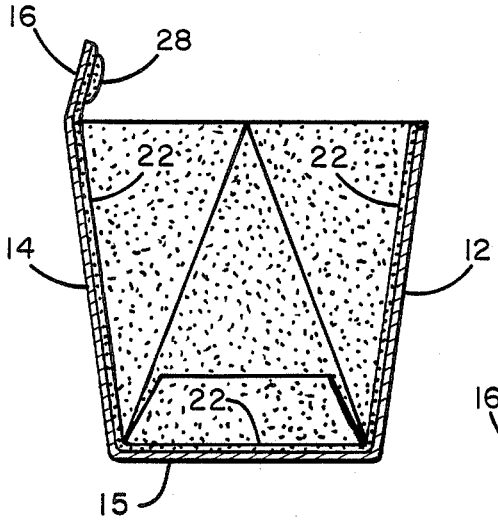
FIG. 4 is a view, partially in section, of the outer container of the expandable food package of the present invention as viewed along the section line 4—4 of FIG. 1.

As will be described in greater detail below, and as illustrated in both FIG. 1 and FIG. 4, at least a portion 22 of the inside surface of the container 10 is coated with a material which, when exposed to microwave energy, softens and becomes tacky and causes that portion of the inner surface to fuse or stick to the expandable pouch 29 (FIGS. 2 and 3). The advantages of the present invention can be achieved by applying such a coating 22 to the entire inside surface of the container 10 or only to various portions of the inner surface of the container. In one embodiment (as shown in FIG. 9) the structure is provided with such a coating only near the base of the container 10. Such a structure allows the expandable pouch 29 to climb the inner surface of the sidewalls 11–14 and completely expand without becoming prematurely fused or affixed to the sidewalls.

In another embodiment of the present invention, the entire inside surface of the container is coated with a cotaing 22. This is the embodiment illustrated in FIGS. 1, 4, 6 and 7 and is the preferred embodiment.

In an alternate embodiment illustrated in FIG. 9, only those portions of the inner surface of the container 10 where adhesion is desired are coated with the first coating. Specifically, only the base 15 and a portion of the lower edges of the sidewalls are coated with material 25 which, when exposed to microwave energy, will adhere to the pouch 29.

Although it is contemplated that a variety of materials could be used for the coating described above, it must preferably have certain characteristics. The coating which, when exposed to microwave energy, adheres to the food pouch 29, should be solid at room temperature and become soft and tacky when exposed to microwave energy of a level needed to pop the kernels of popcorn. During the popping procedure according to the present invention, the oil in the package will be heated to about 300° to 325° F. until the corn starts popping. The temperature of the oil will then decrease. In the preferred embodiment and method, this coating is a polyethylene or parafin based material which is commonly used in the food industry to coat the exterior surface of food packages. Such material normally functions as a moisture barrier or sealer in prior art packages. Some common coatings that would function satisfactorily as the coating in the structure and method of the present invention include common polyethylene coatings as may be applied to board stock or any heat sealable coating applied to board stock such as those manufactured by Mobil, Du Pont and W. R. Grace.

FIGS. 2 and 3 illustrate the expandable food pouch 29. In the preferred embodiment, the pouch 29 is comprised of a pair of opposed layers of synthetic, high polymer film 30 and 31. The two layers 30 and 31 can be of the same or of different compositions as long as they are effective for maintaining shelf stability during the storage of the food product. The material from which these layers are made must also be capable of withstanding the temperatures and moisture vapor developed upon heating in a microwave oven. Additionally, the material from which the layers 30 and 31 are made must be capable of forming an effective seal with each other so that they can be sealed about their peripheral edges to form an enclosed space between them.

The seal 32 which is formed along the peripheral edges of the opposed layers 30 and 31 provides an enclosed space between the layers which is large enough to accommodate expansion of the food product 27. When the food product is a product such as popcorn, the space available for expansion should preferably be at least ten times the original volume of the unpopped kernels. The seal formed between the layers 30 and 31 can be formed by use of adhesives, solvents or heat sealing means known in the art. Preferably the seal is made by heat sealing, with the width of the seal being between about ⅛ and ½ inches. To accomplish the heat seal, the inner surfaces of the layers 30 and 31 are provided with a heat sealing material.

Figure 12:
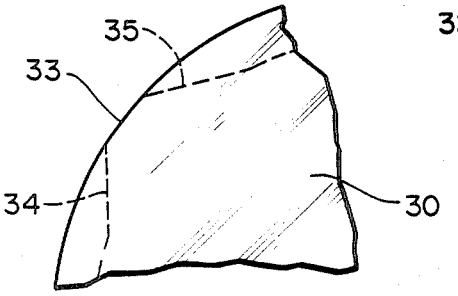
FIG. 12 is an elevational view of an edge portion of the pouch showing an embodiment of the designed fault.
Figure 8:
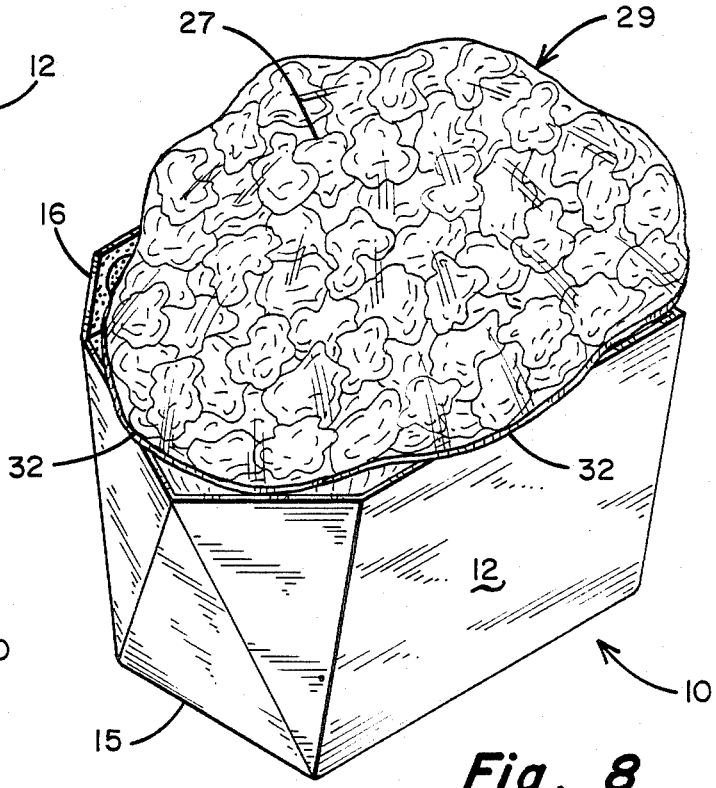
FIG. 8 is a pictorial view of the expandable food package of the present invention showing the outer container and the inner pouch in its fully expanded form and containing expanded popcorn.

Because of the expansion of the air within the pouch upon heating and the expansion of the popcorn as it pops, significant pressure is built up within the pouch 29. This pressure creates stress on the inside surface of the pouch to a level where some of it must be released. If the edge seal 32 is strong enough, this stress is capable of causing the pouch to burst or explode. If the seal 32 is weaker than the pouch material itself, as is usually the case, a portion of the seam will fail. In prior art structures, neither the location of this failure nor the size of the opening is predictable. In the structure of the preferred embodiment of the present invention as shown in FIGS. 2 and 12, the edge seal 32 of the pouch 29 is provided with a designed fault or weakened portion 33. This designed fault 33 is a narrowed portion or an absence of the seal 32 which causes the seam 32 to fail at the fault 33.

In the preferred structure, the inner edge of the pouch edge seal 32 converges to the outer edge of the pouch along the converging seal lines 34 and 35. These lines 34 and 35 converge to the opening 33. Because of the varying thickness of the edge seal along the converging lines 34 and 35 the extent of the failure, and thus the size of the opening in the pouch along the lines 34 and 35 will depend upon the magnitude of the pressure formed within the pouch 29. In the preferred embodiment the opening 33 comprises the absence of a seal about one quarter of an inch wide and the lines 34 and 35 converge toward the opening 33 from a distance about one inch on either side of the opening. It is also contemplated that the opening 33 could comprise a narrowed seal portion as well as the total absence of a seal.

The film material used to form the food pouch 29 should be substantially impermeable to oxygen and moisture so that it maintains the freshness of the packaged product for a commercially acceptable period of time. While storage of at least six months, and preferably twelve months, are considered necessary, the exact time will depend upon the nature of the food product. In the case of popcorn packaged with fat, the film must not permit significant changes in the moisture content of the popcorn kernels and must not permit oxygen to permeate the film to cause rancidification of the fat. In the preferred structure the outer surfaces of the layers 30 and 31 are coated with an oxygen and moisture barrier such as SURLYN manufactured by Du Pont.

It is preferable for both layers 30 and 31 of the pouch 29 to be made of the same material. It has been found that a polyester such as polyethylene terephthalate is an especially effective packaging material for this particular purpose because of its low oxygen and moisture permeabilities. Preferably the film layers 30 and 31 should have a thickness of between about 0.027 mm and about 0.0254 mm. Various materials other than polyethylene terephthalate can also be used. For example, it is known in the art that suitable alternative film materials which can be employed are laminates of polyvinylidene chloride and polyethylene, polyvinylchloride and polypropylene. Also, various Nylon based materials can be used.

Prior to forming the pouch illustrated in FIGS. 2 and 3 with the enclosed central portion the food product 27 must be formed between the layers. This can be done by placing a layer of film onto a supporting structure and then placing the desired amount of food product such as a mixture of popcorn kernels and butter or vegetable fat onto the film. A second film layer is then positioned on top of the first layer and the seal 32 is formed about the peripheral edge. The designed opening 33 and the lines 34 and 35 are formed by utilizing an appropriately designed heat seal means. Excess material is then cut from the pouch and the pouch is ready for placement into the container 10. In the preferred embodiment, the diameter of the generally circular flattened pouch 29 (in inches) is approximately one-fourth to one-half the area of the container top in its open position (in square inches). Preferably the diameter of the pouch is about one-third the area of the container top.

To construct the expandable food package in accordance with the present invention, the paperboard material from which the outer container 10 is made is first prepared by coating the same with a material such as a polyethylene or parafin based material which, when exposed to microwave energy, adheres to the food pouch 29. Next a blank is cut from this material and then assembled to form the outer container 10. The food pouch 29 with an expandable food product such as popcorn contained therein is placed in the container 10 with the seam 32 disposed horizontally as shown. The container is then closed into the configuration shown in FIGS. 6 and 7 and the flap 16 is secured to the upper outside edge of the sidewall 12 by the portions of adhesive 28, 28 (FIG. 1). The package is then ready for use.

Although the description of the preferred embodiment and method has been quite specific, it is contemplated that various modifications could be made without deviating from the spirit of the present invention. Accordingly, it is contemplated that the scope of the present invention be dictated by the appended claims rather than by the description of the preferred embodiment.

We claim:

1. A microwave popcorn package capable of accommodating the expansion of popcorn during exposure to microwave energy, said package comprising:

an outer container having an inner surface defined by a base and a plurality of sidewalls extending upwardly from said base to define an operable top;

an expandable food pouch disposed within said container in contact therewith but free of any connection to said container, said food pouch containing unpopped popcorn; and a coating on at least a portion of said inner surface of said container, said coating comprising a material which is solid at room temperature and which becomes tacky when said container with said coating thereon and said expandable food pouch with popcorn therein is exposed to microwave energy at a level sufficient to pop said popcorn, said coating applied to said container relative to said pouch such that said container with said coating thereon is capable of securing said expandable food pouch to said inner surface of said container during and subsequent to exposure to said microwave energy sufficient to prevent said expandable pouch from shifting during said exposure and thereafter.

2. The package of claim 1 wherein said coating is a polyethylene or parafin based coating.

3. The package of claim 1 wherein one of said sidewalls includes a flap portion adapted for securement to an opposite sidewall for maintaining said package in a closed position, said flap being provided with a heat sensitive adhesive which is released when exposed to microwave energy.

4. The package of claim 1 wherein said coating is applied only to said base.

5. The package of claim 1 wherein said coating is applied only to said base and a lower edge portion of said sidewalls.

6. The package of claim 1 wherein said expandable food pouch is constructed of a polyester film material.

7. The package of claim 1 wherein each of said sidewalls is generally trapezoidally shaped.

8. The package of claim 1 wherein the area of said base is between one-third and two-thirds the area of the top of said container in its open position.

9. The package of claim 8 wherein the area of said base is about one-half the area of the top of said container in its open position.

10. The package of claim 1 wherein said food pouch is generally circular in its flattened position and whereas the height of said sidewalls is between one-fourth and one-half the diameter of said food pouch.

11. The package of claim 10 wherein the height of said sidewalls is about one-half the diameter of said food pouch.

12. The package of claim 1 wherein said food pouch is generally circular and the diameter of said food pouch is between one-fourth and one-half the area of the top of said container in its open position.

13. The package of claim 12 wherein the diameter of said food pouch is about one-third the area of the top of said container in its open position.

14. The package of claim 1 wherein said base is generally rectangular and wherein each of a pair of opposing sidewalls is comprised of three triangular sections, one of said triangular sections having a side defining the lower edge of said sidewall and an apex at the top edge of said container.

15. The package of claim 1 wherein said base is generally rectangular and each of an opposing edge of said base is provided with an upwardly extending tab section.

16. The package of claim 1 wherein said container is expandable and in its unexpanded position has a generally rectangular cross-sectional configuration.

17. The microwave popcorn package of claim 1 wherein said coating comprises a material which becomes tacky when said container with said coating thereon and said expandable food pouch with popcorn therein is exposed to microwave energy at a level sufficient to pop said popcorn, said level comprising a temperature of approximately 300° F. to 325° F.

* * * * *